US011624594B1

(12) United States Patent
Neal, III et al.

(10) Patent No.: US 11,624,594 B1
(45) Date of Patent: Apr. 11, 2023

(54) DEVICE, METHOD AND SYSTEM FOR EXTENDING RANGE AND IMPROVING TRACKING PRECISION OF MORTAR ROUNDS

(71) Applicant: Barron Associates, Inc., Charlottesville, VA (US)

(72) Inventors: David A. Neal, III, Charlottesville, VA (US); Aaron B. Olowin, Charlottesville, VA (US); William T. Gressick, Charlottesville, VA (US)

(73) Assignee: Barron Associates, Inc., Charlottesville, VA (US)

( * ) Notice: Subject to any disclaimer, the term of this patent is extended or adjusted under 35 U.S.C. 154(b) by 310 days.

(21) Appl. No.: 17/162,545

(22) Filed: Jan. 29, 2021

Related U.S. Application Data

(60) Provisional application No. 63/002,413, filed on Mar. 31, 2020.

(51) Int. Cl.
*F42B 10/20* (2006.01)

(52) U.S. Cl.
CPC ..... *F42B 10/20* (2013.01)

(58) Field of Classification Search
CPC ..... F42B 10/00–66
See application file for complete search history.

(56) References Cited

U.S. PATENT DOCUMENTS 4,708,304 A * 11/1987 Wedertz ..... F42B 10/12 244/3.28
6,234,082 B1 * 5/2001 Cros ..... F42B 14/02 102/520
6,880,780 B1 * 4/2005 Perry ..... F42B 10/14 244/49
7,004,424 B1 * 2/2006 Pacchia ..... F42B 10/64 102/400
7,147,181 B2 12/2006 Selin et al.
7,952,055 B2 5/2011 Turner et al.
8,237,096 B1 8/2012 Alexander et al.
(Continued)

FOREIGN PATENT DOCUMENTS

EP 1092941 4/2001
JP 1260299 8/2000

OTHER PUBLICATIONS

Terhune, R. et al., "Extending FIN Concept for a 105-mm FIN Stabilized Projectile", Technical Report ARMET-TR-10039—U.S. Army Armament Research, Development and Engineering Center, Munitions Engineering Technology Center, Apr. 2011.
(Continued)

*Primary Examiner* — Justin M Benedik
(74) *Attorney, Agent, or Firm* — Williams Mullen; Thomas F. Bergert

(57) ABSTRACT

A system, device and method provide a glide kit that can attach to a conventional mortar round to create a glide-enabled round. The glide-enabled round can fit within a mortar tube. When the munition exits the mortar tube, it sequentially deploys wings and canards to initiate the glide maneuver and increase the mortar range. A state estimator subsystem can be employed with a canard control subsystem to actively guide the mortar to a fixed location. The combination of the estimator and canard control subsystems improves the tracking precision of the mortar round.

18 Claims, 10 Drawing Sheets

(56) References Cited

U.S. PATENT DOCUMENTS

| | | | | |
|---|---|---|---|---|
| 8,319,164 | B2 | 11/2012 | Martinez | |
| 8,552,351 | B2 | 10/2013 | Geswender et al. | |
| 8,674,277 | B2 | 3/2014 | Axford et al. | |
| 8,674,278 | B2 | 3/2014 | Buckland et al. | |
| 9,086,258 | B1 * | 7/2015 | Vasudevan | F42B 30/10 |
| 9,347,750 | B2 | 5/2016 | Larsson | |
| 9,360,286 | B2 | 6/2016 | Petersson et al. | |
| 9,677,864 | B1 | 6/2017 | Jankowski et al. | |
| 2011/0024550 | A1 * | 2/2011 | McDermott | F42B 10/44 244/3.27 |
| 2011/0297783 | A1 * | 12/2011 | Martinez | F42B 15/01 244/3.21 |
| 2012/0068002 | A1 * | 3/2012 | Unger | F42B 10/64 244/3.28 |
| 2015/0330755 | A1 * | 11/2015 | Citro | F42B 10/14 102/501 |
| 2017/0191809 | A1 | 7/2017 | Harris et al. | |

OTHER PUBLICATIONS

Alliant Techsystems Inc., "Precision Guided Mortar Munition (PGMM)", available at http://www.atk.com/Customer_Solutions_MissionSystems/cs_ms_w_gp_pgmm.asp, Jul. 31, 2007.

Oldham, Chuck, "Raytheon Precision Extended Range Munition (PERM) Tests Successful", Defense Media Network, Dec. 2, 2014.

Hambling, David, "The Marines' Trusty Mortar is Getting a Major Upgrade", Popular Mechanics, Jun. 2, 2016.

* cited by examiner

Fig. 1
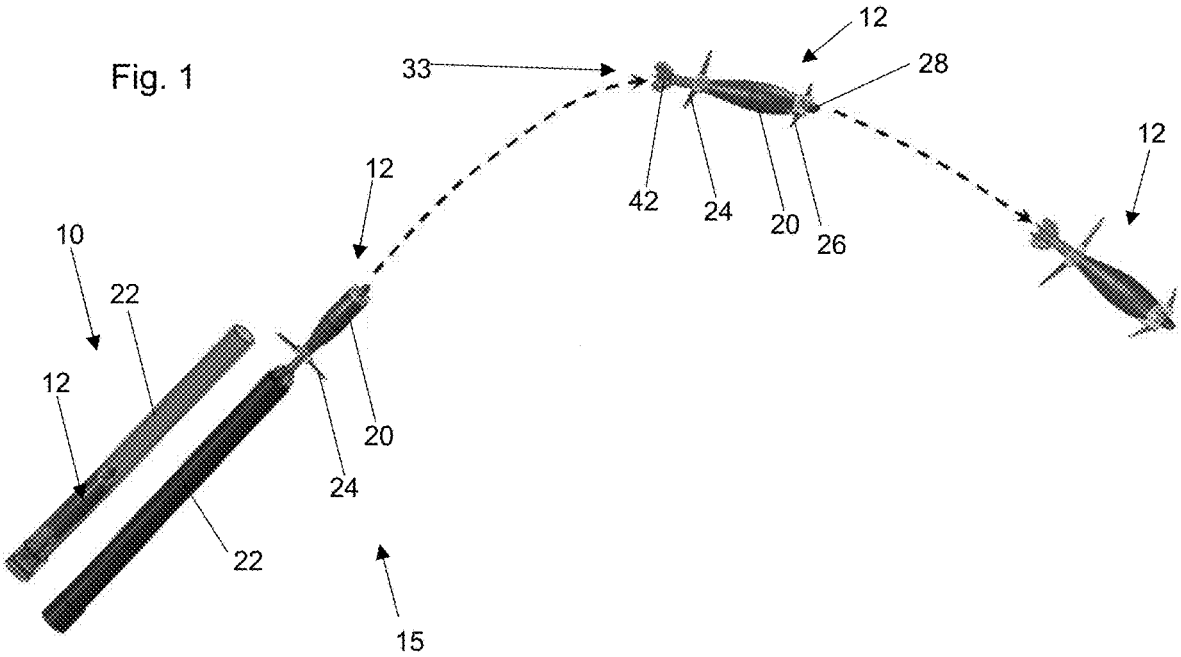
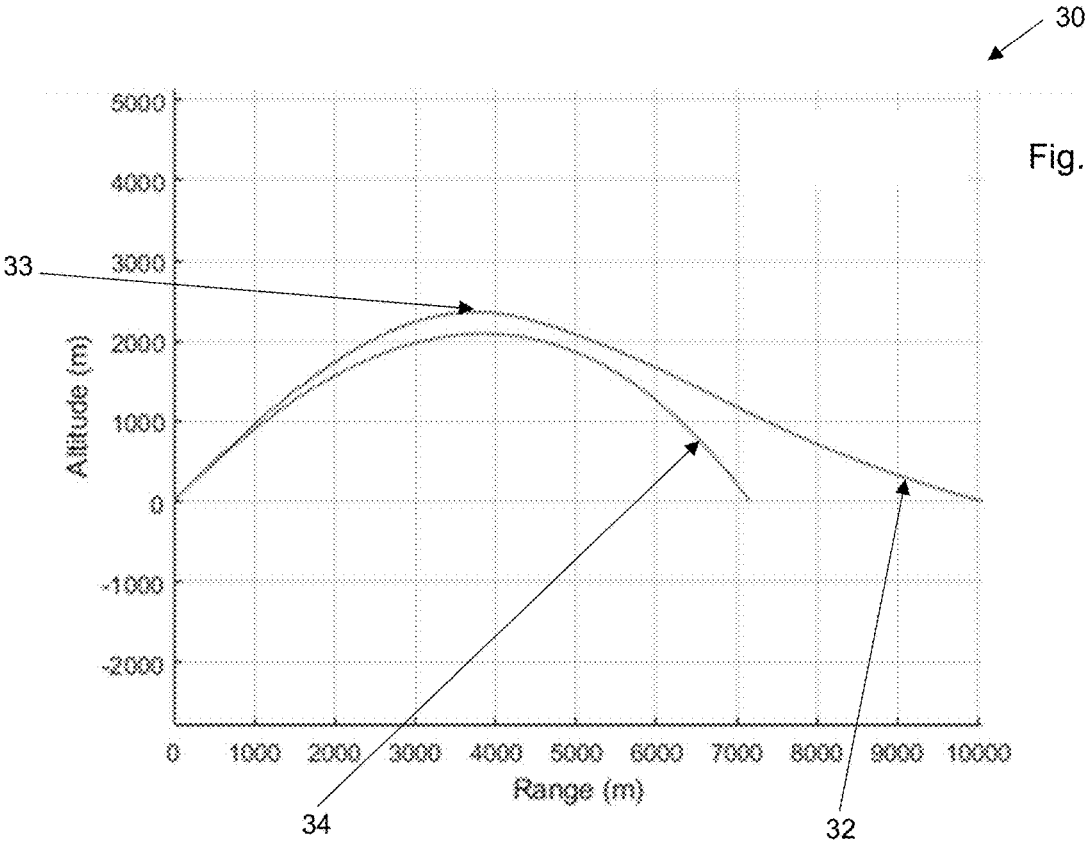
Fig. 2

DEVICE, METHOD AND SYSTEM FOR EXTENDING RANGE AND IMPROVING TRACKING PRECISION OF MORTAR ROUNDS

Cross Reference to Related Applications

The present application claims priority to U.S. provisional application No. 63/002,413, filed on Mar. 31, 2020, the contents of which are incorporated by reference herein in their entirety.

STATEMENT

This invention was made with government support under contract no. W15QKN-17-C-0084 awarded by the United States Army. The government has certain rights in the invention.

TECHNICAL FIELD

The present disclosure pertains to mortar rounds, and more particularly, to a mortar augmentation system, device and method that extends range, reduces impact dispersion and approximates the range and deflection of a mortar round.

BACKGROUND AND SUMMARY

Conventional mortar rounds, such as the M934 mortar round, are limited in their range, generally have a broad impact dispersion and are subject to a wide circular error probable (CEP). CEP is the radius of a circle within which fifty percent of the rounds would land corresponding to perturbations in launch conditions, winds, and other factors.

Embodiments of the present disclosure provide a mortar augmentation system, which can include an add-on glide kit for an existing mortar round, a state estimator subsystem to approximate the mortar range and deflection and a canard control subsystem to actively guide the mortar to a fixed location. According to embodiments described herein, the glide kit does not replace whole sections of the mortar round but is rather an add-on kit that enhances range and reduces impact dispersion. In various embodiments, the precision control comprises a mechanical articulation combined with a software algorithm as described herein.

The glide kit can be employed with various sizes of rounds, including 120 mm, 81 mm and 60 mm mortar rounds. In various embodiments, the glide kit consists of flight surfaces that attach to the front and rear of a standard mortar round. The flight surfaces are adapted to fold-up against the body of the mortar round in order to fit within a mortar launch tube. After launching from the mortar tube, the flight surfaces deploy to provide aerodynamic glide capability to the mortar. The aerodynamic glide capability can increase the nominal range of a 120 mm mortar, for example, by approximately forty percent.

In various embodiments, the flight surfaces consist of front flight surfaces referenced as canards herein and rear flight surfaces referenced as wings herein. The canards and wings attach to the mortar round using distinct housings, which may be formed of metal, for example. The front or canard housing contains the deployable canards. The rear or wing housing contains the deployable wings. In various embodiments, the canard housing is secured around the front of the round just behind the fuse location and the wing housing is secured around the tail fin assembly.

In some embodiments, the wing housing includes springs to deploy the wings, and a ratchet-style spring tab to hold the deployed wings in place. When the wings are stowed, i.e., folded against the mortar body, a cord such as an Aramid cord, for example, can be wrapped around the wings to prevent them from unfolding. During the launch from the mortar tube, the heat from the igniting charges disintegrates the cord. This allows the wings to deploy once the round exits the mortar tube. Initially, only the wings deploy and the mortar round climbs to its maximum altitude. At the peak altitude, the canards can be deployed such as by an electrical circuit, for example.

In certain embodiments, the canard housing can include springs to deploy the canards and a ratchet-style spring tab to hold the deployed canards in place. When the canards are stowed, i.e., folded against the mortar body, a cord can be wrapped around them to prevent them from unfolding. The cord can be fastened using Nichrome resistance heating wire, for example. The canards can be deployed by electrically connecting a battery to the Nichrome wire, whereby, once the battery is connected to the wire, the wire disintegrates, allowing the canards to deploy.

In certain embodiments, a restraint cord such as a Vectran cord can wrap around each of the canards to prevent them from unfolding. The Nichrome wire can be wrapped around the Vectran restraint cord. When the battery is connected to the Nichrome wire, it heats up and cuts through the restraint cord, allowing the canards to deploy.

In various embodiments, the canard housing includes a circuit board to time the deployment of the canards based on the measured shock load, for example. The circuit board can measure the launch shock using an onboard shock sensor. This initiates a timer onboard a microprocessor or controller. Once a determined amount of time has passed, the controller uses a switch to electrically connect a battery to the Nichrome wire. The current from the battery connection heats the Nichrome wire so that it burns through the restraint cord. The cord releases, and the canards spring-deploy to unfold from the body. The ratchet-style spring tab holds the canards in their deployed configuration. When the canards deploy, they cause the gliding mortar round to pitch upward into an optimal flight angle for maximum range glide performance.

In various embodiments, additional circuitry and actuators are provided to make small changes in the canard sweep angle to achieve precision control. For example, the canard housing can include an accelerometer and a barometric pressure sensor. Based on measurements received from the accelerometer and barometric pressure sensor, the on-board controller can determine a launch angle and barrel speed of the mortar round. The controller can further determine a charge weight for the mortar round based on the barrel speed, a desired impact point based on the launch angle and charge weight, and a position and velocity of the mortar round based on the launch angle and barrel speed. Based on the determined position and velocity, the controller can determine a projected impact point for the mortar round. By understanding the desired impact point and the projected impact point, the controller can adjust the canard rotation angle to a position between the fully undeployed position and the fully deployed position so as to more accurately control the mortar round and reduce impact dispersion, for example.

In various embodiments, small rigid wing segments or passive fin connector vanes are secured between the existing mortar fins. These “fin-vanes” provide additional stabilization during the initial mortar launch and also help to improve the aerodynamic glide performance.

The state estimator subsystem according to the present disclosure can approximate the mortar range and deflection without using GPS, according to various embodiments. The range and deflection estimates can be integrated into the canard control system of the present disclosure to actively guide the mortar to a fixed location.

BRIEF DESCRIPTION OF THE DRAWINGS

FIG. 1 is an exemplary schematic diagram of operations of a device and system in accordance with embodiments of the present disclosure.

FIG. 2 is an exemplary graph comparing the range of a mortar round with and without a glide kit according to embodiments of the present disclosure.

DETAILED DESCRIPTION OF EMBODIMENTS

Figure 3A:
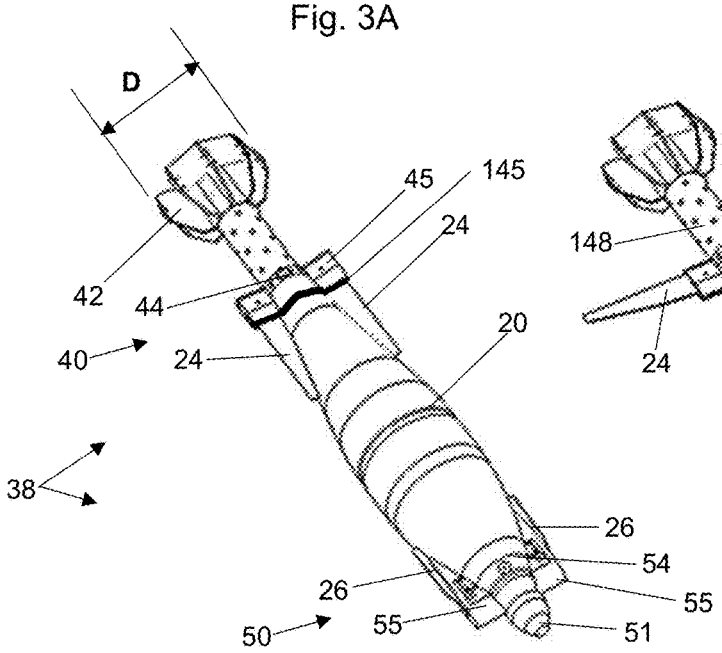
FIGS. 3A through 3D are perspective views of a mortar round with a secured glide kit at various stages of deployment according to embodiments of the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as disclosed herein can incorporate a controller having a processor and an associated memory storing instructions that, when executed by the processor, cause the processor to perform operations as described herein. It will be appreciated that reference to "a", "an" or other indefinite article in the present disclosure encompasses one or more than one of the described element. Thus, for example, reference to a controller encompasses one or more controllers, reference to a measurement encompasses one or more measurements, reference to a canard or wing encompasses one or more canards or wings and so forth.

FIG. 1 shows a munition 12 according to the present disclosure in its stowed 10 and deployed 15 configurations. A mortar round body 20 is stowed in a mortar tube 22 with an attached glide kit having wings 24 secured to a tail fin assembly 42 of the munition 12 and canards 26 secured around or to a nose 28 of the munition 12. After the glide munition 12 exits the mortar tube 22, it sequentially deploys wings 24 and canards 26 to initiate the glide maneuver and increase the mortar range. Embodiments of the glide-kit include pop-out wings and canards and employ shape memory alloy (SMA) technology as described elsewhere herein to deploy, lock, and control the flight surfaces.

FIG. 2 is an exemplary graph 30 that compares the range of a munition with the glide kit of the present disclosure attached and without a glide kit under identical launch conditions. As can be seen, the range 32 of a munition with glide kit attached is much further than the range 34 of a munition without the glide kit of the present disclosure attached. For example, the mortar round range 34 without glide kit is shown as 7.1 km and the mortar round range 32 with glide kit is shown as 10.1 km in FIG. 2. In various embodiments as described herein, the canards 26 are deployed at the peak altitude 33 of the munition 12 after launch.

As shown in FIGS. 3A through 23, embodiments of the present device provide variations of glide kits 38. Certain variations of glide kits as disclosed herein provide only range extension. In such variations, the canards 26 fully deploy one-time and lock in-place for the remainder of the glide maneuver. There are reduced sensor and active control requirements and corresponding lower cost associated with such a design. Other variations of glide kits as disclosed herein have adjustable canards 26 which achieve both range increase and CEP decrease (i.e., range extension with greater precision control). Such variations combine a state estimator subsystem and canard control subsystem with active canard sweep control as disclosed herein to guide the mortar round out to a desired impact distance regardless of the launch perturbations or atmospheric conditions.

As can be seen from the drawings, embodiments of the glide kit 38 include separate front 50 and rear 40 modules. The front module 50 incorporates deployable canards 26. As described above with reference to FIGS. 1 and 2, the canards 26 can be deployed at the peak altitude 33 after launch. In various embodiments, the front module 50 can contain batteries, sensor hardware, and a deployment system to actuate and lock the canard rotation. The front module 50 can further contain SMA wire to actuate and lock the canard rotation. In various embodiments, the front module 50 mounts behind the mortar round fuse 51 and wraps around the mortar body 20 such as by interference or friction fit to secure in-place. The rear module 40 contains deployable wings 24. In various embodiments, the wings 24 deploy and lock-in place immediately after launch. Embodiments of the rear module 40 can be provided as purely mechanical with no sensors or power system in accordance with the present disclosure.

Figure 3B:
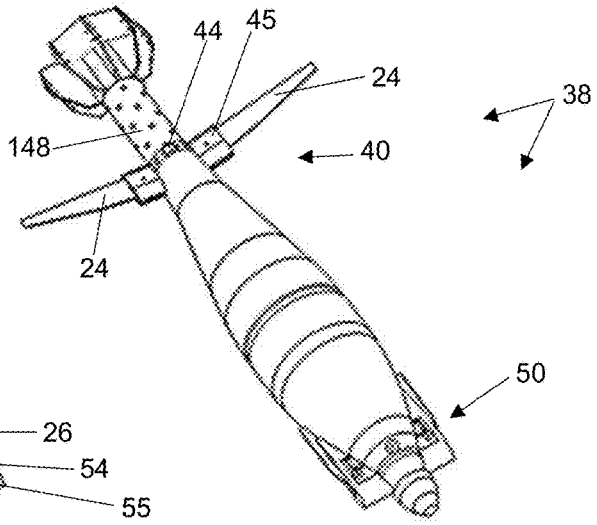
Figure 3C:
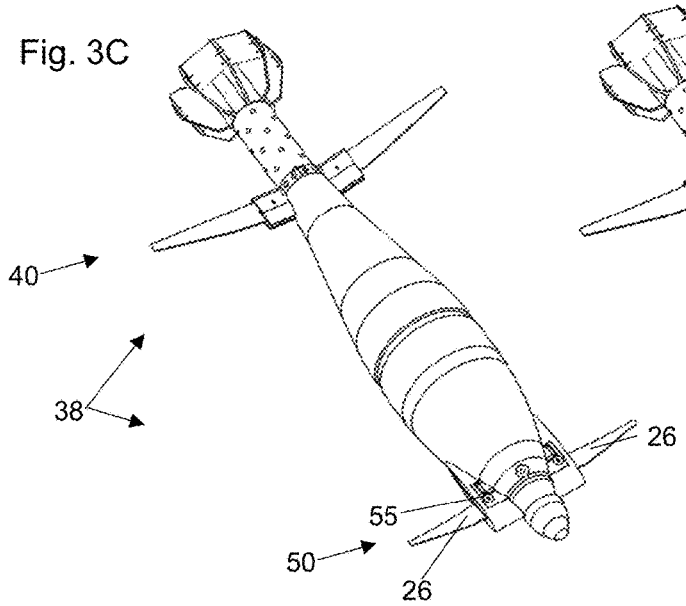

FIGS. 3A through 3D show how the munition 12 according to the present disclosure changes configuration during operation. When being loaded into the launch tube 22 and prior to launch, which is illustrated schematically at 10 in FIG. 1, the flight surfaces are initially stowed, i.e., the wings 24 and canards 26 are in the undeployed position as shown in FIG. 3A. After barrel exit, which is illustrated schematically at 15 in FIG. 1, the wings 24 deploy to stabilize the ballistic ascent and the canards 26 remain stowed as shown in FIG. 3B. The deployed wings 26 provide both pitch stability and roll stability during the initial ascent. At the trajectory peak, illustrated at 33 in FIG. 1, the canards 26 are deployed into flight configuration to initiate the glide maneuver as shown in FIG. 3C. The canards 26 increase the glide-range and the munition 12 executes a gliding descent until ground impact. Deploying the canards 26 causes the equilibrium angle-of-attack to increase which generates greater lift. The munition 12 with deployed flight surfaces 24, 26 is statically and dynamically stable and requires no active control to maintain its flight trajectory.

Figure 3D:
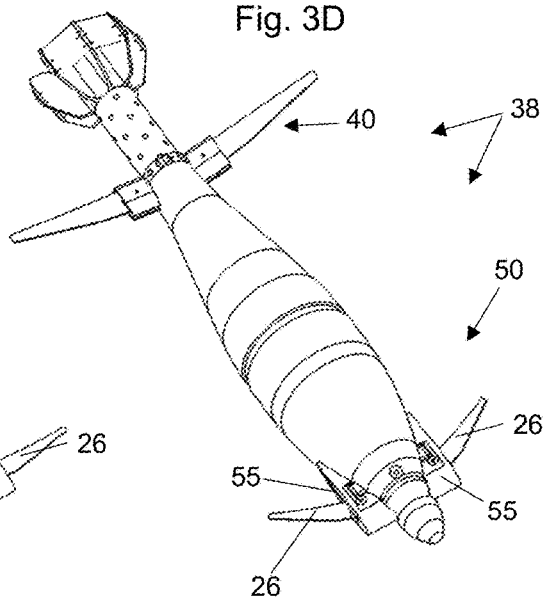
Figure 4:
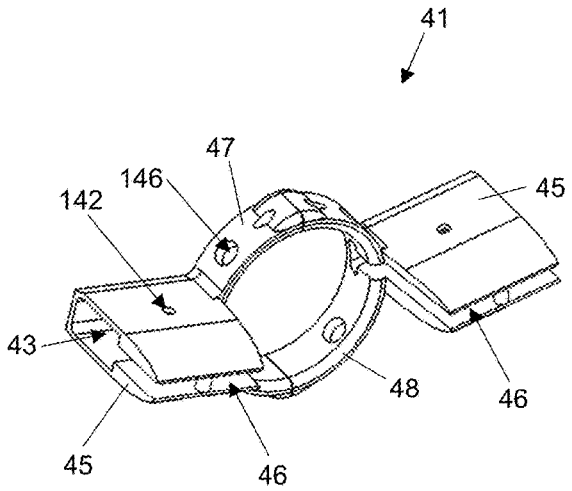
FIG. 4 is a perspective view of a wing housing in accordance with embodiments of the present disclosure without wings installed.
Figure 5:
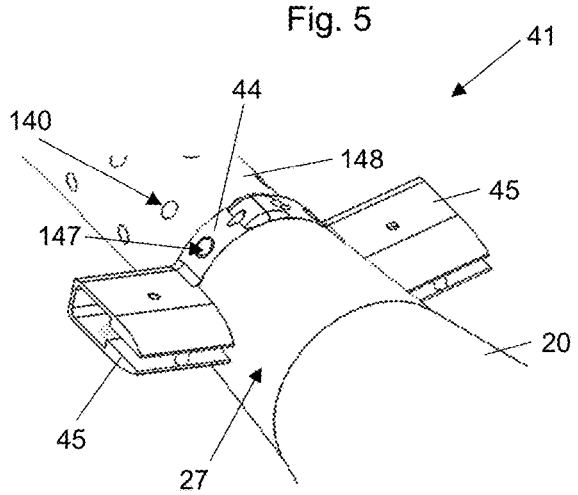
FIG. 5 is a perspective cutaway view of the wing housing of FIG. 4 secured to a mortar round in accordance with embodiments of the present disclosure.
Figure 6:
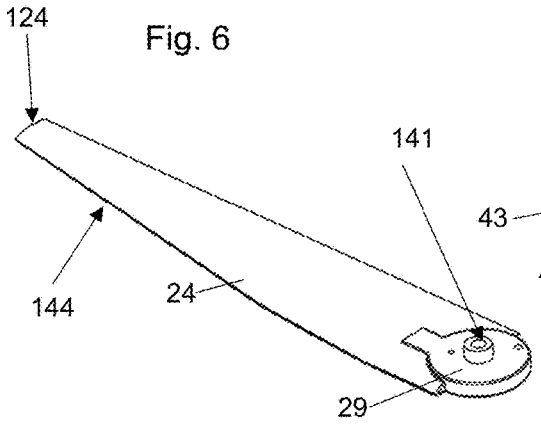
FIG. 6 is a perspective view of an exemplary wing and rotation mount in accordance with embodiments of the present disclosure.
Figure 7:
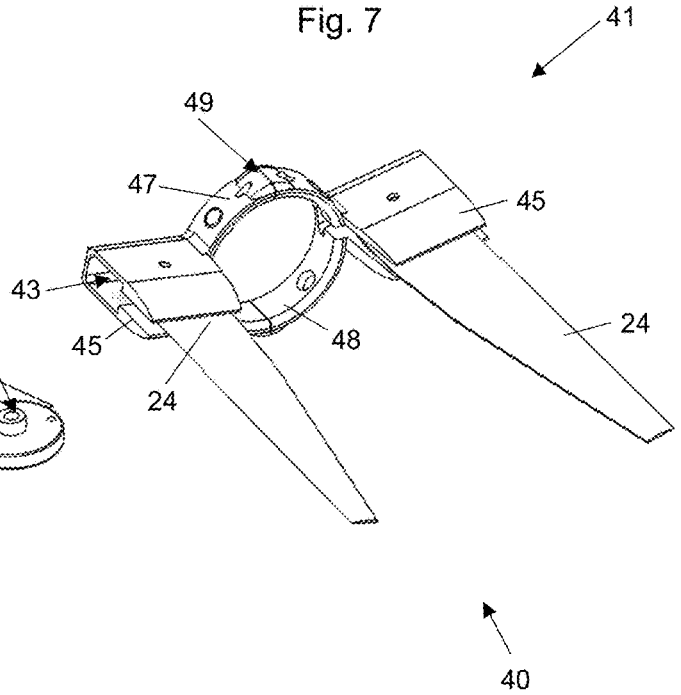
FIG. 7 is a perspective view of a wing housing with installed wings in accordance with embodiments of the present disclosure.

During the gliding descent, the canard sweep angle can be actively controlled to control the munition's pitch attitude and corresponding glide range. This is illustrated in FIG. 3D, where the canards 26 are at a position between undeployed (as in FIG. 3B) and fully deployed (as in FIG. 3C). Varying the canard sweep angle and/or level of deployment assists in decreasing downrange dispersion. The CEP can be reduced by targeting a fixed impact distance that corresponds to the charge weight and launch angle. It will be appreciated that the port and starboard canard sweep angles can be varied independently and asymmetrically to control the munition's bank attitude and the corresponding deflection (i.e., lateral error in the landing point), as described elsewhere herein. It will further be appreciated that the front 50 and rear 40 modules are provided so as not to exceed the widest diameter D of the munition without the glide kit attached. For example, as shown in FIG. 3A, the tail fin assembly 42 and the mortar body 20 can be provided with a diameter D that fits with desired tolerance within a launch tube 22 for proper launch operation. The front 50 and rear 40 modules do not exceed the diameter D when the canards 26 and wings 24 are undeployed so as to avoid impeding loading and launch operations. Further, given the shape of the mortar body 20, the outer edges 124 of the wings 24 face the outer edges 126 of the canards 26 when in the undeployed position as there is greater lateral space for the wing housing 41 and canard housing 52 in the areas nearer the axial ends of the mortar round.

As shown in FIGS. 4 through 9, the rear module 40 includes a wing housing 41 and wings 24. The wing housing 41 includes a wing base ring 44 secured to wing guides 45, wherein each wing guide 45 is formed with radially outer slots 43 extending radially outwardly from the mortar body 20 when secured and axially outer slots 46 extending in a direction axially aligned with the mortar body 20 when secured. The slots 43, 46 permit proper wing rotation during operation. In various embodiments, the wing base ring 44 is formed by joining a first ring piece 47 to a second ring piece 48. The ring pieces 47, 48 may optionally be joined together with a suitable snap 49 or other mechanical attachment. In various embodiments, the wing base ring 44 clamps around the mortar tube 20 at the cylindrical section just aft of the tapered section 27 and just ahead of the ignition holes 140. Additionally, one or more holes 146 can optionally be formed in the wing base ring 44 and a pin 147 can be pressed through the wing base ring 144 and into the tail shaft 148 to secure the wing housing 41 to the shaft 148 during the high-G launch. Embodiments of the wing surfaces consist of GOE389 flat-bottomed airfoils. In various embodiments, the wing platform is tapered as at 144 to fit alongside the curvature of the munition body 20 when in the undeployed position. Each wing can be secured to a relatively flat, cylindrical rotation mount 29 that rests and is pivotally secured within its respective wing guide 45. For example, rotation mount 29 can be provided with a flange mount 141 for engaging a rod 142 (not shown) to permit wing 24 to rotate within the wing guide 45. In various embodiments, the wings 24 are initially restrained by rope 145 such as Aramid rope.

Figure 8:
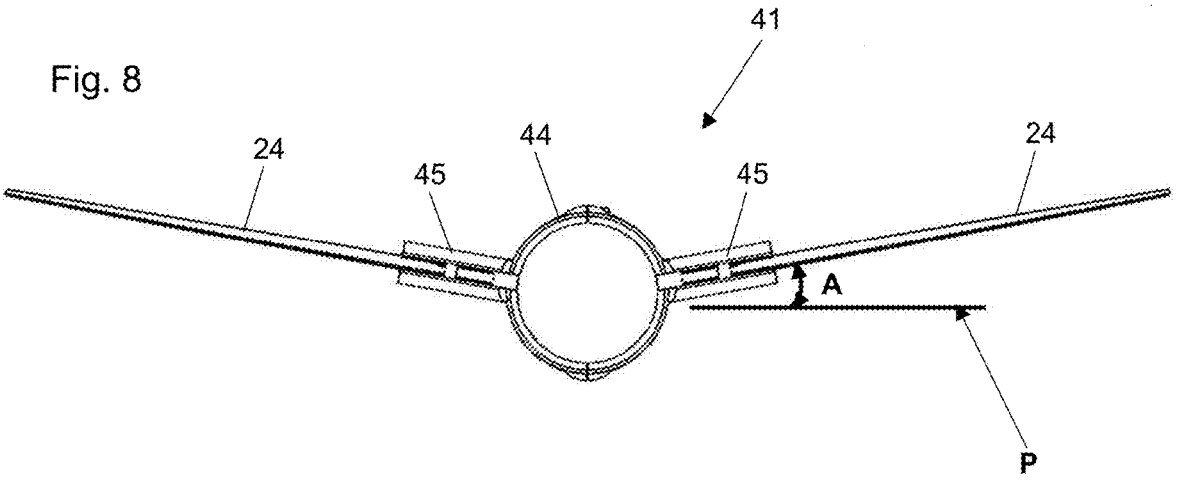
FIG. 8 is a front elevation view of a tail fin assembly with installed wings in accordance with embodiments of the present disclosure.
Figure 9:
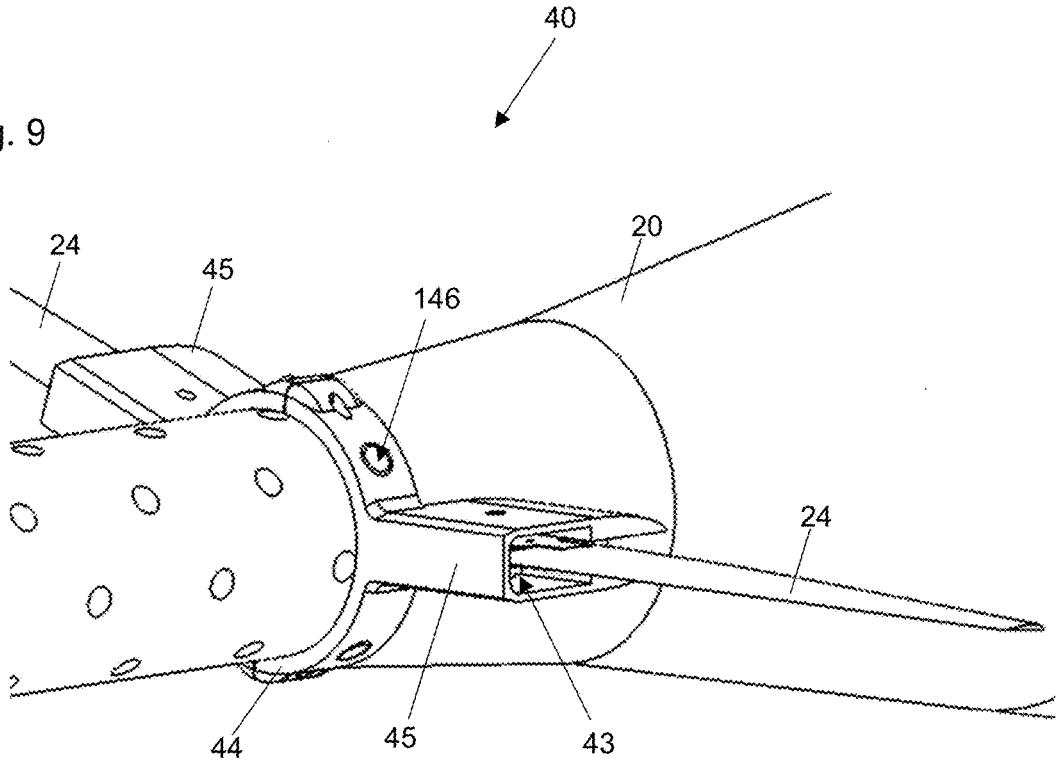
FIG. 9 is a right perspective cutaway view of a tail fin assembly with installed wings secured to a mortar round in accordance with embodiments of the present disclosure.

In various embodiments such as shown in FIG. 8, for example, the wing housing 41 orients the wing mounts 29 at a dihedral angle A, measured relative to the horizontal plane P of the mortar body. Therefore, the wings deploy with an initial dihedral angle. Dihedral is used on gliders to maintain an upright wing orientation without requiring active roll control. In various embodiments, the dihedral angle A can be ten degrees. In other embodiments the dihedral angle A can be as low as zero degrees and as high as forty-five degrees.

When the munition 12 is disturbed from the upright roll orientation, the lift builds up on one side of the wing more than the other. This creates a restoring moment which return the wings to the upright orientation. By deploying the wings 24 just after tube exit with built-in dihedral, the enhanced munition 12 according to the present disclosure will settle at a wings-up orientation during the initial ascent even with wind perturbations. The dihedral will cause the munition 12 to maintain the wings-up orientation during the gliding descent. This provides passive roll stability without high bandwidth actuators to maintain the desired roll orientation.

Figure 23:
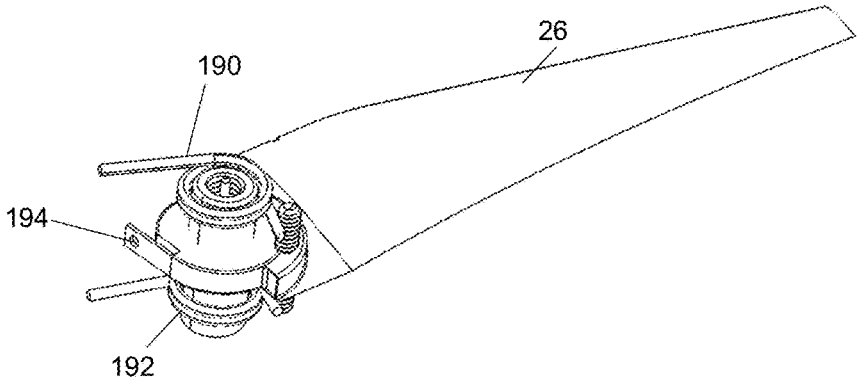
FIG. 23 is a perspective view of an exemplary canard with torsion springs in accordance with embodiments of the present disclosure.

Wing rotation can be accomplished in various ways. For example, the wing guides 45 can contain a torsion spring to initiate the wing deployment and a ratchet mechanism to prevent bounce-back. The torsion spring can be mounted below the wing and initiate the unfolding. As the wing unfolds, the ratchet pushes the pawl out of the way, depressing the compression spring. At each increment of the deployment, the compression spring can push the pawl in to mate with the ratchet gear. The shape of the pawl and mating ratchet tooth can prevent the ratchet from pushing the pawl forward. During the deployment, as each ratchet gear tooth passes over the pawl, the wing is prevented from moving in the reverse direction. The one-way wing deployment locks in the final position when the wing contacts the back of the wing housing. The ratchet approach can be simplified to a single spring tab that deploys after the wing rotates and locks the wing in the final, fully extended position. As shown in FIG. 23, the spring tab lock, 194, is essentially a single-tooth ratchet that engages a slot in the canard, 26, to lock it into the fully-extended configuration. An alternative to the ratchet approach described above is a one-way clutch bearing that prevents bounce-back and locks the wings 24 in place.. The torsion spring deployment previously discussed can be modified to include an upper and lower extension spring to increase the deployment force. Finally, the housing can be modified to incorporate a knurled surface to grip onto the fin shaft when the housing is tightened. The knurled steel surface will deform the aluminum shaft to enhance the grip in order to survive the high-G shock. In various embodiments, the wing system is unpowered and does not require battery or control. In the assisted deployment embodiment, the spring initiates the wing deployment. However, once the wings are unfolded past the mortar round body profile (outside of the flowstream coming off of the mortar body 20), the drag force will supplement the spring force to complete the wing deployment. This drag force will apply a constant rearward force against the wings to ensure that the locking mechanism has time to fully engage.

Figure 10:
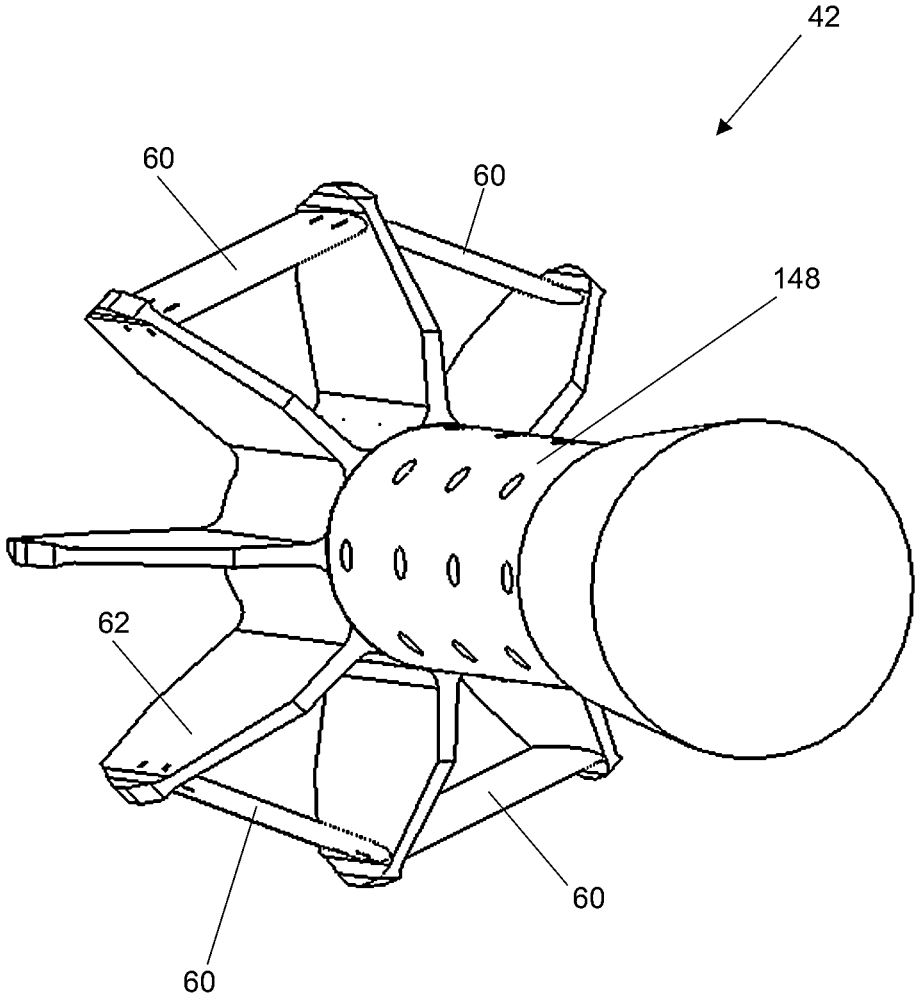
FIG. 10 is a perspective view of passive fin connectors attached between a plurality of fin pairs of an exemplary mortar round in accordance with embodiments of the present disclosure.

As shown in FIG. 10, fin connector vanes 60 can be provided as part of the tail fin assembly 42 of the glide kit according to embodiments of the present disclosure. The fin connector vanes 60 can provide distinct aluminum airfoil surfaces that bridge the space between the original mortar fins 62. The fin connector vanes 60 provide aerodynamic stabilization when the munition 12 is first launched, until the wings 24 deploy. The fin connector vanes 60 are passive stabilization surfaces and can be bolted onto the existing fins 62, for example. In embodiments such as shown in FIG. 10, a pair of fin connector vanes 62 sits atop the munition 12 (together, the upper fin connectors) and another pair of fin connector vanes 62 sits below the munition (together, the lower fin connectors).

As shown in FIGS. 11 through 22, embodiments of the glide kit 38 according to the present disclosure include independently controllable canards 26 which can be modulated symmetrically to control range or modulated asymmetrically to control bank angle and reduce lateral offset. The canards 26 can be controlled via the canard control subsystem as described herein.

The front module 50 including the canard housing 52 and canards 26 attaches to the front end of the mortar round body 20. In various embodiments, the canard housing 52 includes top 54 and bottom 56 members having a portion with a concave shape (e.g., 53 in top member 54 and 59 in bottom member 56), wherein the top 54 and bottom 56 members can be joined together such that the concave portions form a substantially frustoconical ring. In at least one embodiment, a screw or similar device is screwed into one or more extractor holes 57 to secure the canard housing 52 to the mortar body 20, and any remaining holes remain available to extract the mortar body 20 out of the mortar tube 22 in case of misfire. In other embodiments, the canard housing 52 is secured to the mortar body 20 through an interference fit facilitated by the frustoconical ring shape of the joined concave portions 53, 59 of the top 54 and bottom 56 members.

The canard housing 52 further includes canard deployment shrouds 55, which can be formed with and extend from the concave portion 59 of the canard housing bottom member 56. Each canard deployment shroud 55 is adapted to retain a respective canard 26 so as to permit the canard 26 to rotate and/or pivot about a respective canard axis (e.g., X and Y in FIG. 14). The canard deployment shrouds 55 can be formed so as to be diametrically opposite one another, and each canard deployment shroud 55 can be formed with a top slot 150 on the top surface 152 thereof, wherein the top slot 150 is adapted to receive a corresponding flange 160 on the top member 54 of the canard housing 52. Each flange 160 can be secured within a respective top slot 150 using a screw extending through an opening (e.g., 155) or a similar attachment mechanism.

The canards 26 are mounted within the canard housing 52 and rotate about fixed pivot axes to deploy. Like the wings 24, the canard surfaces can consist of GOE389 flat-bottomed airfoils. The canards 26 are tapered so that when they are stowed, they fit alongside the curvature of the munition body 20 and do not extend beyond the outer moldline of the mortar body 20.

Figure 11:
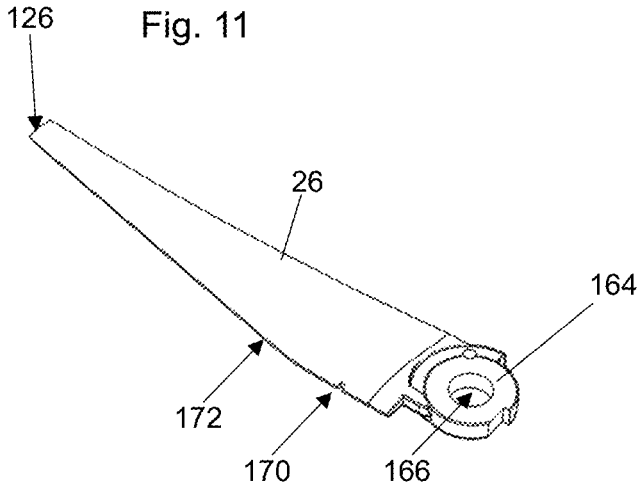
FIG. 11 is a perspective view of an exemplary canard and rotation mount in accordance with embodiments of the present disclosure.
Figure 12:
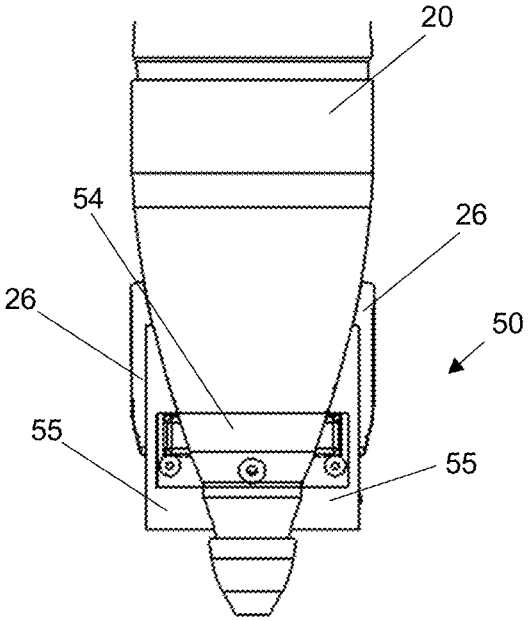
FIG. 12 is a top plan view of a cutaway of an exemplary mortar round with a canard housing secured thereto with canards in the undeployed position in accordance with embodiments of the present disclosure.
Figure 13:
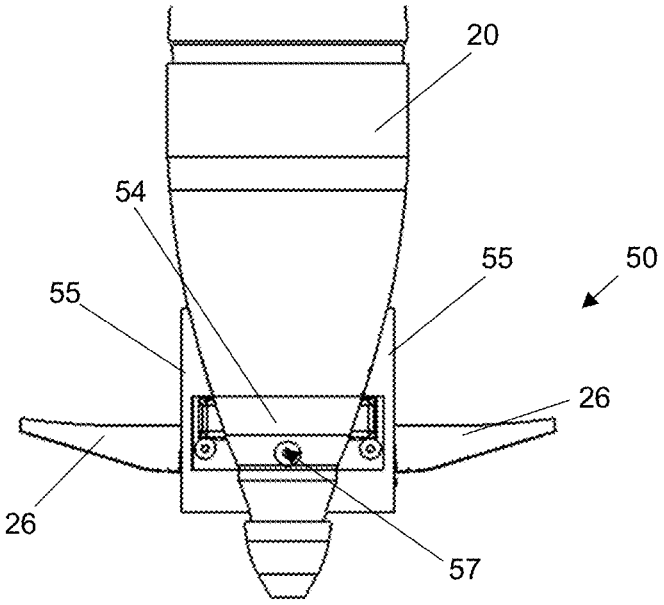
FIG. 13 is a top plan view of a cutaway of an exemplary mortar round with a canard housing secured thereto with canards in the fully deployed position in accordance with embodiments of the present disclosure.
Figure 14:
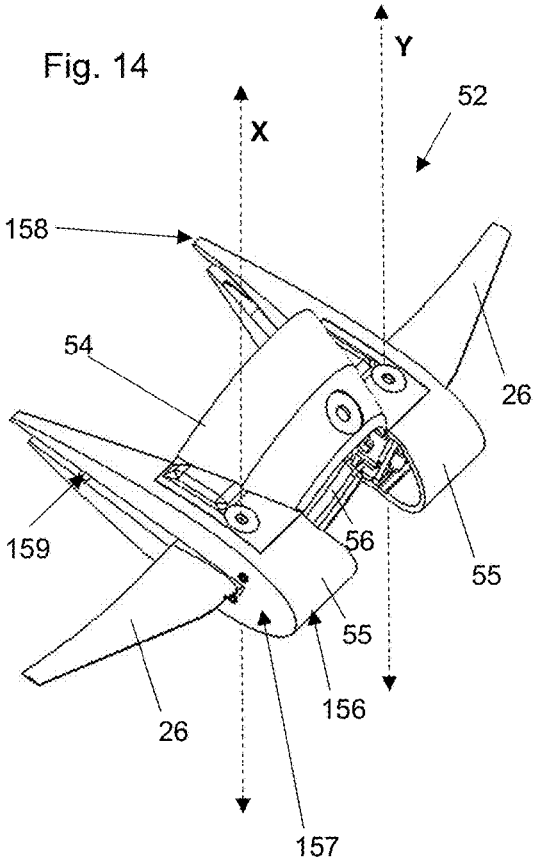
FIG. 14 is a perspective view of a canard housing with canards in the fully deployed position in accordance with embodiments of the present disclosure.
Figure 15:
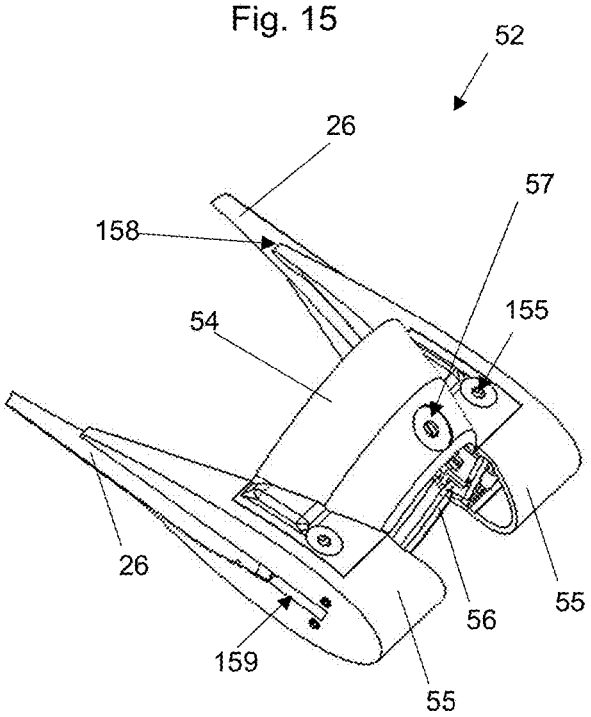
FIG. 15 is a perspective view of a canard housing with canards in the undeployed position in accordance with embodiments of the present disclosure.
Figure 16:
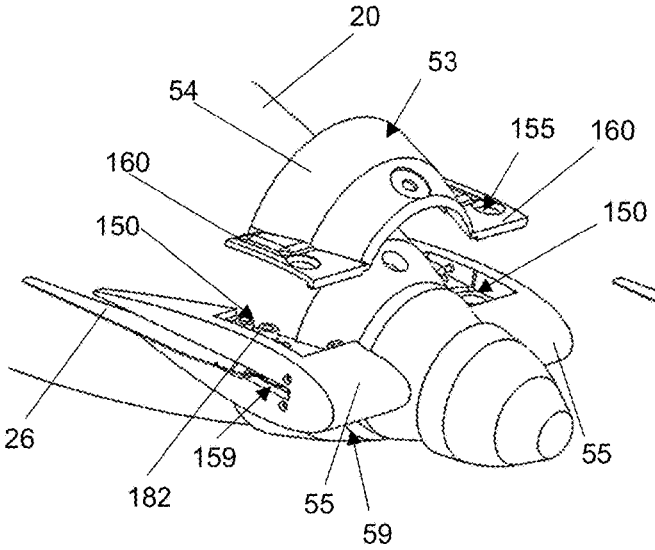
FIG. 16 is a perspective cutaway view of components of a canard housing secured to an exemplary mortar round, with the components in a detached position in accordance with embodiments of the present disclosure.
Figure 17:
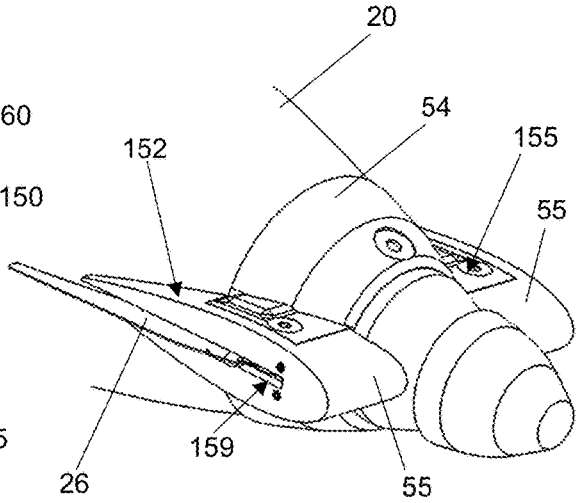
FIG. 17 is a perspective cutaway view of components of a canard housing secured to an exemplary mortar round, with the components in an attached position in accordance with embodiments of the present disclosure.
Figure 18:
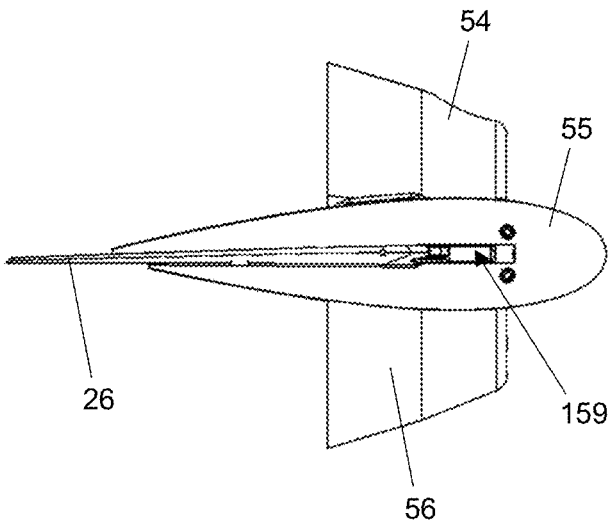
FIG. 18 is a side view of a canard housing with canards in the undeployed position in accordance with embodiments of the present disclosure.
Figure 19:
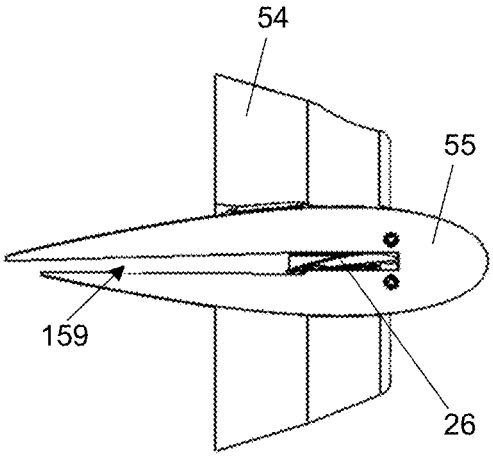
FIG. 19 is a side view of a canard housing with canards in the fully deployed position in accordance with embodiments of the present disclosure.
Figure 20:
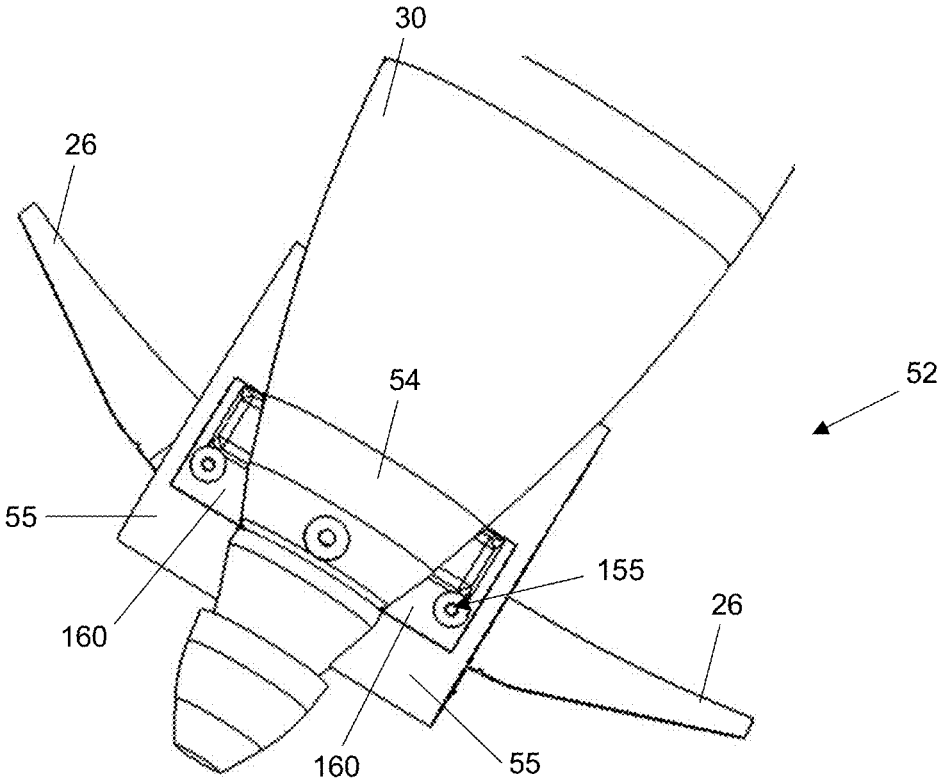
FIG. 20 is a top plan view of a canard housing with a cutaway mortar round, illustrating a first canard in an intermediate deployed position and a second canard in a fully deployed position in accordance with embodiments of the present disclosure.

The canard housing shrouds can be airfoil-shaped to substantially increase the glide performance of the munition 12. In various embodiments, each shroud 55 is formed with a leading edge 156, an outer side edge 157 and a trailing edge 158, wherein the outer side edge 157 and the trailing edge 158 of each shroud 55 is further formed with an outer slot 159 which permits rotating movement of a respective canard 26 about its respective axis (e.g., X or Y). As shown in FIG. 11, each canard 26 is secured to a canard rotation mount 164, which can be formed with a canard mount opening 166 for mating with a rotation pin (not shown) secured in the canard housing shroud 55 along a respective axis X or Y to permit pivoting and/or rotating movement of each canard 26 within the outer slot 159. As further shown in FIG. 11, each canard 26 can be formed with an indentation 170 on a leading surface 172 wherein the indentation 170 can be employed to retain a rope or cord during operation.

As shown in FIG. 23, one or more torsion springs 190, 192 are provided and can be mounted onto each rotation pin, operable to simultaneously press against the canard 26 and the canard housing 52 to rotate the canard 26 to its final, fully extended position. In various embodiments, two torsion springs are incorporated for each canard. On each side, a first torsion spring 190 is mounted above the canard 26 and a second torsion spring 192 is mounted below the canard 26.

The upper 190 and lower 192 torsion springs both mount around the rotation pin and press against a second pin (not shown) through the canard 26. The canards 26 can be restrained in their stowed position by a cord such as a Vectran cord that wraps around the canard 26 and into the outer slot 159 of the canard shrouds 55. In various embodiments, the Vectran cord is stretched across Nichrome wire and secured internally to resist the torsion springs 190, 192. When an electrical signal is sent to the Nichrome wire, it heats up and burns the Vectran cord, allowing the torsion springs 190, 192 to deploy the canards 26.

Similar to the wing deployment, in various embodiments, a spring tab lock 194 can be employed to restraint the canard 26 in its fully deployed position. The spring tab lock 194 can be embodied as a single-tooth ratchet that pops out once the canard 26 rotates to restrain the canard 26 in the fully deployed, i.e., fully extended position.

Embodiments of the shroud airfoil can be a NACA 0030 shape with 30% maximum thickness, for example, where the large airfoil thickness is required to cover the one or more batteries. In various embodiments, each canard housing shroud 55 houses one or more batteries, at least one sensor, a canard deployment mechanism and a canard locking mechanism. The sensor(s) can include a barometric pressure sensor, a shock sensor and/or an accelerometer.

In various embodiments, SMA wire can be used to control the canard 26 deployment angle. SMA wire is a hybrid blend of Nickel and Titanium formed as small diameter wire (25 μm up to 510 μm). The wire can contract up to a certain percentage (e.g., four to six percent) of its length when electrically driven or heated. The alloy changes its internal structure from Martensite (low temperature state, low Modulus of Elasticity) to Austenite (high temperature state, high Modulus of Elasticity) when it is heated. When the wire is cool (Martensitic state), it can be pre-stretched and when heated, it will contract back to the original length while providing substantial retraction force. In accordance with the present disclosure, the SMA wire is integrated as an actuator to control the canard deployment.

Figure 21:
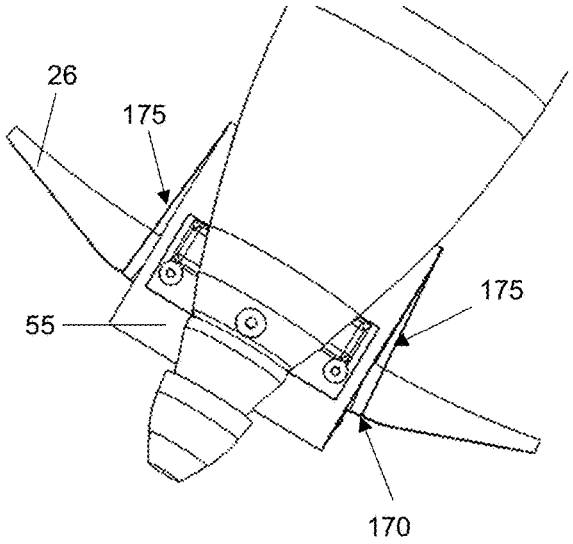
FIGS. 21 and 22 are top plan views of a canard housing with a cutaway mortar round, illustrating wire canard control in accordance with embodiments of the present disclosure.
Figure 22:
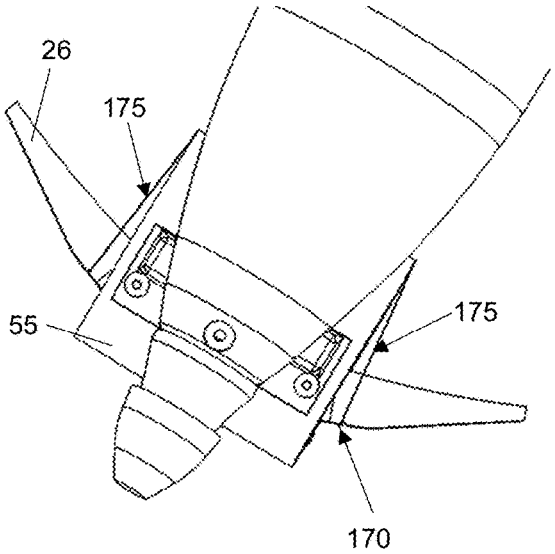

The SMA wire can be configured as a lever mechanism for canard deployment. The lever mechanism provides mechanical advantage which is well suited to SMA wire. In various embodiments, the SMA wire pulls against the torsion spring(s) used to deploy each canard 26. Because SMA can only recover a small amount of strain, the lever mechanism enables small wire contraction to create a large rotation of the canard. When the canard 26 is stowed, the SMA wire 175 is fully stretched in its low-Modulus Martensitic state. When the canard 26 is spring-deployed to its maximum position, the SMA wire is still in its fully stretched low-Modulus Martensitic state. When the canard 26 is to be adjusted, the SMA wire 175 is electrically heated to contract somewhere between full contraction and full stretch, as shown in FIG. 22. This causes the canards to retract to some intermediate sweep angle. To reduce the canard angle, the SMA wire is electrically heated until it is somewhere between the low-Modulus Martensitic state and the high-Modulus Austenitic state. The increases stiffness and contracting of the SMA wire overcomes the torsion spring stiffness to rotate the canards aft, reducing the canard angle. To increase the canard angle, the electrical heating to the SMA is decreases and the stiffness of the SMA reduces, allowing the torsion springs to push the canard out further and simultaneously expand the SMA to its original fully-stretched state. The electrical heating of the SMA can be precisely controlled to achieve intermediate canard angles. As shown in FIGS. 21 and 22, the SMA wire 175 is secured within the indentation 170 of the leading surface 172 of each canard 26.

For the embodiments of the present disclosure with canard deployment control, the power to the SMA wire can be modulated based on the canard sweep angle commanded by the controller.

To complete the canard control circuit, a feedback device is required for determining the rotation angle. An exemplary feedback device is a rotary membrane potentiometer which can be positioned on the bottom plane of the canard 26. Membrane potentiometers consist of flat resistance tracks printed on either foil or FR4 circuit board. As a wiper rod moves along the circular resistance track, it changes the electrical resistance, which corresponds to a rotation angle. For the canard deployment control aspects according to the present disclosure, the canard lever pin acts as the wiper rod. When the canard 26 rotates, the lever arm slides across the membrane potentiometer, changing the electrical resistance. The change in electrical resistance is sent to the microcontroller to determine the corresponding sweep angle. This is the feedback signal for active canard sweep control.

An alternative canard deployment system includes an upper and lower extension spring that pulls against a dowel pin in the canard to deploy it. This system can employ a one-way clutch bearing that is secured to the canard's rotation shaft. The outer housing of the bearing is secured to the canard such as by press-fit, for example, while the inner race of the bearing rides on a shoulder bolt proceeding through the canard housing. The shoulder bolt is fixed in place and the canard/bearing is able to rotate forward due to the spring excitation. However, the clutch bearing prevents the canard from rotating backwards. This system prevents "bounce-back" of the canards and holds them in their fully deployed state. The clutch bearing canard locking mechanism can only be implemented on the variations of the glide kit for range extension because the clutch bearing prevents modulation of the canard sweep angle.

It will be appreciated that the wing and canard surfaces can be fabricated with a preset inclination angle to optimize aerodynamic performance. The wings 24 can be fabricated with the flight surface angled relative to the rotation plane. When the wings 24 rotate outward to deploy, the flight surface is already inclined relative to the flowstream to provide a pitch-up moment contribution. The axis of inclination is such that the inclined flight surface has negligible impact on the round's aerodynamics when the wings 24 are stowed. There is substantial impact once the wings 24 rotate outward. Likewise, the canards 26 can be fabricated with the flight surface angled relative to the rotation plane. Once the canards 26 deploy, they are already inclined to provide a pitch-up moment contribution.

It will be appreciated that the canard control subsystem 240 can be independent for the left and right canards 26. In such embodiments, each canard 26 has its own SMA circuit, battery, and feedback sensor, enabling independent control of each canard 26. When the canards 26 are asymmetrically contracted such as in FIG. 20, for example, a small roll moment will be generated which can be used to control the munition's bank angle. This will allow the glide-munition's lateral offset to be modulated as atmospheric winds blow the munition off its nominal course.

Figure 24:
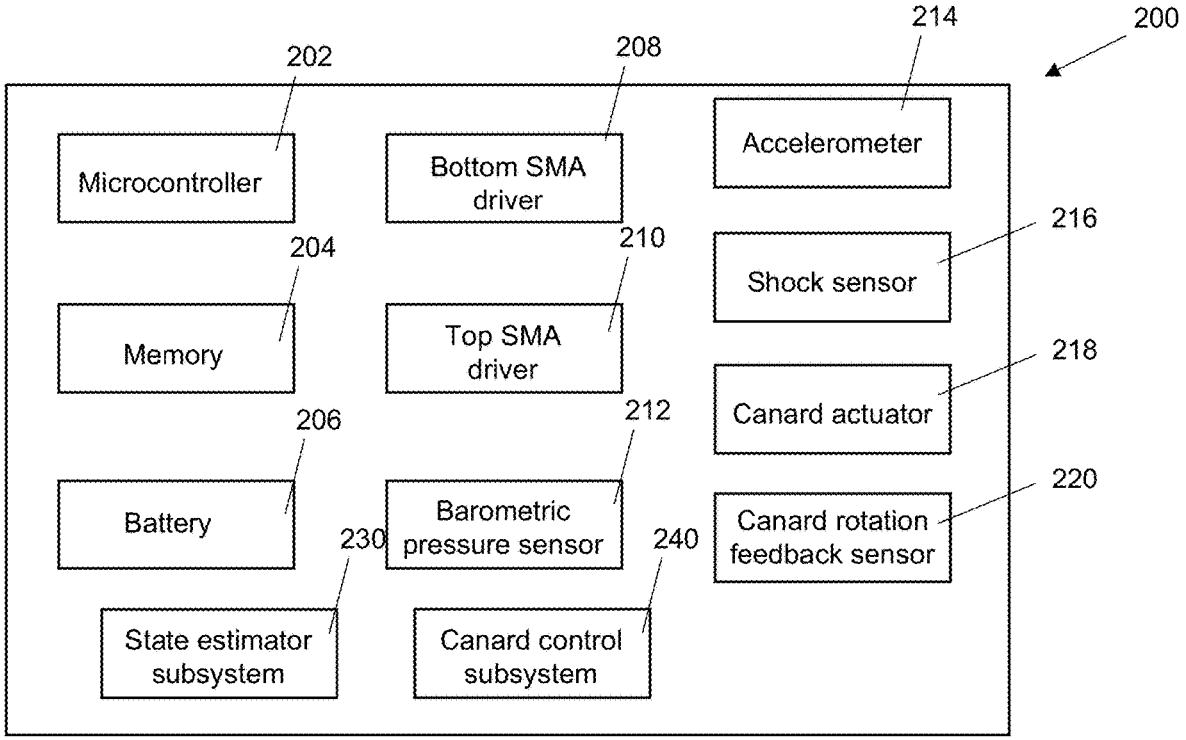
FIG. 24 is a block diagram illustrating components of a controller and/or controller system in accordance with embodiments of the present disclosure.

FIG. 24 is a block diagram illustrating components of a processing system 200 that can be provided to incorporate the onboard state estimator subsystem 230 and canard control subsystem 240. Such system 200 can be integrated into the glide kit 38 such as by storage within one or more canard housing shrouds 55.

As shown in FIG. 24, the system 200 can include a microcontroller (or "controller") 202, memory 204, battery 206, a left SMA driver 208 to actuate the left canard, a right SMA driver 210 to actuate the right canard, a barometric pressure sensor 212, an accelerometer 214, a shock sensor 216, a canard actuator 218 and a canard rotation feedback sensor 220. The system 200 can also include state estimator subsystem 230 and canard control subsystem 240. Embodiments of the battery 206 can include a 4V, 200 mAh, 7 A max current, 50,000 G shock rated lithium metal oxide battery. Embodiments of the left SMA driver 208 can include an SMA driver with PWM directional output and 2.5 A max current to control the left SMA wire. Embodiments of the right SMA driver 210 can include an SMA driver with PWM directional output and 2.5 A max current to control the right SMA wire. Embodiments of the barometric pressure sensor 212 can include a MEMS digital barometer, 3.8-18.2 psi, 10,000 G shock rated, measures altitude up to 30,000 feet. Embodiments of the accelerometer 214 can include a tri-axial accelerometer, ±4 G up to ±30 G, 10,000 G shock rated. Embodiments of the shock sensor 216 can include a shock sensor with an electrical trigger at 4,000 G Shock, shock rated to 20,000 G. Embodiments of the canard actuator 218 can include 380 μm SMA wire with 4.4 lbs pull force. Embodiments of the canard rotation feedback sensor 220 can include a resistive potentiometer, printed on FRF circuit board, with 0-90° customized sensing range. It will be appreciated that the microcontroller 202, left SMA driver 208, right SMA driver 210, barometric pressure sensor 212, and accelerometer 214 can be provided on a circuit board secured within the canard housing 52.

In various embodiments, the state estimator subsystem 230 is a two-part state estimator that accurately estimates the launch velocity and angle of a given mortar round with the glide kit 38 installed, with no inputs from a user. The state estimator subsystem 230 can also compute the atmospheric winds during the glide maneuver. In various embodiments, the state estimator subsystem 230 can rely solely on the barometer 212 and accelerometer 214 as sensor inputs. A launch estimator portion of the state estimator subsystem 230 can simultaneously determine the launch conditions and compute the accelerometer bias error, using the first few seconds of post-launch sensor data, for example. A wind and state estimator portion of the state estimator subsystem 230 can approximate the glide munition's position, velocity, and atmospheric winds. The estimated launch conditions and winds are used to accurately predict the glide-munition's position and velocity. This data and the target point can be used by the microcontroller 202 and memory 204 storing programming instructions to determine how the canard rotation angle should be adjusted to guide the munition to the desired impact point. In various embodiments, the programming uses the current state values and wind values to approximate where the glide-munition will impact. The programming internally iterates on the canard rotation angles to find the settings that will minimize deflection and range error. In embodiments, the projection controller programming is recalled at a certain update rate during the gliding descent to generate updated canard commands.

It will be appreciated that the state estimator subsystem 230 is operable to detect an adjustment-influencing condition such as launch angle and barrel speed and, based on the detected adjustment-influencing condition, instruct the canard deployment subsystem to deploy at least one of the canards into a different position, such as the canard-expanded position or the canard-adjusted position. The state estimator subsystem 230 can operate with the microcontroller 202 and at least one of the sensors 212, 214, 216.

In various embodiments, a munition as enhanced according to the present disclosure stores a set of pre-determined target impact points in memory 204 that correspond to each combination of charge weight and launch angle. Post-launch, the glide-kit estimates the initial conditions and identifies the closest corresponding impact point (i.e., range target). The canard control subsystem 240 is then used to guide the munition to the range target while minimizing the deflection.

For each mortar launch, the following process can occur:

1) Mortar fires with perturbed velocity and launch angle
2) State estimator determines charge weight and launch angle, e.g., to within 1-degree
3) A lookup table is used to identify corresponding range target based on charge weight and launch angle
4) Controller guides glide munition to target impact range at minimum deflection For bounded perturbations around a nominal launch condition, the estimator algorithm can identify the same range target for each launch. Therefore, repeated mortar launches at the nominal launch condition will all target the same impact point. The estimator and projection controller can guide the mortar to the target despite atmospheric winds and launch perturbations. This CEP attenuation aspect substantially reduces the CEP for a series of mortar launches. As an example, the combination of the state estimator subsystem and canard control subsystem 240 decreases the M934 CEP from 92 m to 42 m, a decrease of 54%.

The microcontroller 202 is thus operable to receive a measurement from one or more sensors, and based on the measurement, deploy a sweep angle adjustment to at least one of the two canards. It will be appreciated that the canard control subsystem 240 is operable to position each of the canards in a canard-undeployed position, a canard-expanded position and a canard-adjusted position between the canard-undeployed position and the canard-deployed position. The canard-adjusted position can represent an adjustment to increase range or improve chances of reaching a desired target, for example.

In various embodiments, the controller 202 is operable to receive a measurement from the accelerometer 214 and the barometric pressure sensor 212 and based on the received measurements from the accelerometer 214 and the barometric pressure sensor 212, determine a launch angle and barrel speed of the mortar round. The controller 202 is further operable to determine the charge weight of the munition based on barrel speed and the desired impact point of the munition based on launch angle and charge weight. The controller 202 is further operable, based on the determination of the barrel speed and launch angle, to predict a position and a velocity of the mortar round. The controller 202 is further operable to determine a projected impact point based on the predicted position and velocity. The controller 202 is further operable to determine a canard rotation angle adjustment based on the predicted position, predicted velocity, desired impact point and projected impact point of the mortar round.

The determined charge weight and launch angle corresponds to a certain time for the glide munition to reach the peak altitude. The left and right canards are fully-extended at the peak altitude. In certain embodiments, SMA can be used to independently adjust the left and right canard angles after the initial deployment. The time to reach peak altitude is stored in a table in the onboard memory based on the charge weight and launch angle. The delay time is stored in the memory to trigger the Nichrome wire to burn through the restraining Vectran on each side of the canard housing to deploy the left and right canards.

The battery 206 can provide a sustained, 2.5 A current output and a peak current of 6.5 A. The microcontroller 202 can run programming stored in memory 204 and/or in the state estimator subsystem 230 and canard control subsystem 240. The microcontroller 202 takes inputs from the accelerometer 214, barometric pressure sensor 212, and rotation feedback sensor 220, and sends SMA commands to the right 210 and left 208 SMA driver ICs. The right SMA driver IC 210 provides high current PWM signals to control right canard contraction. The left SMA driver IC 208 provides high current PWM signals to control left canard contraction.

The shock sensor is rated for 20,000 Gs and will elicit a signal once the 4,000 G shock threshold has been exceeded. This trigger alerts the microcontroller to start processing the estimator algorithms after a determined time delay. The digital barometer provides altitude and altitude-rate date at 25 Hz for the state estimator. It also triggers when the maximum altitude has been achieved so that the canards can be deployed. The electronics module can be mounted at the front of the munition, before the obturator. Therefore, the barometer is not exposed to the high-pressure region around the launch gases.

In various embodiments, the device can be produced using an additive manufacturing process in which a liquid binding agent is deposited to join powder particles. Binder material is placed between each layer. The printed part is placed in an oven to cure and reach full strength. Key benefits of Binder-Jet printing over traditional metal printing (e.g. Direct Laser Metal Sintering) is that a support structure is not required for building the parts, which allows complex internal structures to be fabricated. It also uses far less material than traditional metal printing which greatly reduces the cost.

In various embodiments, the glide-kit components can be fabricated from a 420 Stainless Steel infiltrated with Bronze in a 60/40 ratio of steel to Bronze. The material yield strength is 62 ksi (427 MPa) and the elastic modulus is 21.4 MPsi (147 GPa). The final parts are both machinable and weldable offering many integration options to attach to the mortar round. In embodiments, the total weight of the steel glide-kit components is 530 g. In various embodiments, the canards and wings can be fabricated from aluminum instead of steel which decreases the weight. The steel fabrication of the canard housing and wing housing supports launch survivability.

As described elsewhere herein, the canard control subsystem 240 can be driven by SMA wire. The canards are initially spring-deployed to the fully-extended position. When the SMA wire is heated, the torsion spring is compressed and the canards rotate backward, increasing the sweep angle. When the SMA wire is cooled, the torsion spring unwraps, rotating the canard forward and decreasing the sweep angle. Both motions require active electrical control of the SMA wire to control the Austenite to Martensite transition state and provide controlled motion in each direction. The SMA wire can also be cycled electrically to achieve a continuous canard motion.

Unless otherwise stated, devices or components of the present disclosure that are in communication with each other do not need to be in continuous communication with each other. Further, devices or components in communication with other devices or components can communicate directly or indirectly through one or more intermediate devices, components or other intermediaries. Further, descriptions of embodiments of the present disclosure herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed computers and computing devices, for example. In this regard, a processor (e.g., a microprocessor or controller device) receives instructions from a memory or like storage device that contains and/or stores the instructions, and the processor executes those instructions, thereby performing a process defined by those instructions. Furthermore, aspects of the present disclosure may take the form of a computer program product embodied in one or more computer readable media having computer readable program code embodied thereon.

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium include the following: a portable computer diskette, a hard disk, a random-access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, as exemplified above. The program code may execute entirely on a user's computer, partly on a user's computer, as a stand-alone software package, partly on a user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Where databases are described in the present disclosure, it will be appreciated that alternative database structures to those described, as well as other memory structures besides databases may be readily employed. The drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present disclosure, as will be understood to one of ordinary skill in the art.

The above-described embodiments of the present disclosure may be implemented in accordance with or in conjunction with one or more of a variety of different types of systems, such as, but not limited to, those described below.

The present disclosure contemplates a variety of different systems each having one or more of a plurality of different features, attributes, or characteristics. A "system" as used herein refers to various configurations of: one or more central controllers or microcontrollers, and/or one or more subsystems alone or in communication with one or more central controllers or microcontrollers, for example.

In certain embodiments in which the system includes a server, central controller, or microcontroller, the server, central controller, or microcontroller is any suitable computing device (such as a server) that includes at least one processor and at least one memory device or data storage device. The processor of the additional device, server, central controller, or microcontroller is configured to transmit and receive data or signals representing events, messages, commands, or any other suitable information between the server, central controller, or remote host and the additional device.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented as entirely hardware, entirely software (including firmware, resident software, micro-code, etc.) or combining software and hardware implementations that may all generally be referred to herein as a "circuit," "module," "component," or "system." Furthermore, aspects of the present disclosure may take the form of a computer program product embodied in one or more computer readable media having computer readable program code embodied thereon.

The invention claimed is:

1. A glide kit for a mortar round, comprising:

a wing housing securable to a tail fin assembly of a mortar round;

a plurality of wings pivotably secured to the wing housing;

a canard housing securable to a front portion of the mortar round;

a plurality of canards pivotably secured to the canard housing and operable to be positioned in a canard-undeployed position and a canard-expanded position;

at least one sensor secured within the canard housing, wherein the at least one sensor comprises a shock sensor secured within the canard housing;

a controller secured within the canard housing, wherein the controller is operable to receive a measurement from the at least one sensor and, based on the measurement, deploy the plurality of canards into the canard-expanded position;

a fiber rope cord maintained around each of the plurality of canards to hold the plurality of canards in the canard-undeploved position, wherein the fiber rope cord is operable to release the canards into the canard-expanded position:

a battery secured within the canard housing;

a heating element wire in contact with the fiber rope cord; and wherein the controller is operable to receive the measurement from the shock sensor and electrically connect the battery to the heating element wire based on the measurement from the shock sensor in order to burn through the fiber rope cord to release the canards into the canard-expanded position.

2. The glide kit of claim 1, further comprising a plurality of passive fin connector vanes attachable between a plurality of fin pairs of the mortar round.

3. The glide kit of claim 1, wherein the at least one sensor comprises an accelerometer and a barometric pressure sensor.

4. The glide kit of claim 3, wherein the controller is further operable to receive the measurement from the accelerometer and the barometric pressure sensor, and based on the received measurements from the accelerometer and the barometric pressure sensor, determine a launch angle and barrel speed of the mortar round.

5. The glide kit of claim 4, wherein the controller is further operable to determine a charge weight based on the barrel speed and a desired impact point based on the launch angle and the charge weight.

6. The glide kit of claim 4, wherein the controller is further operable, based on the determination of the barrel speed and launch angle, to predict a position and a velocity of the mortar round.

7. The glide kit of claim 6, wherein the controller is further operable, to determine an estimated atmospheric wind.

8. The glide kit of claim 6, wherein the controller is further operable, based on the determination of the predicted position and velocity of the mortar round, to determine a projected impact point of the mortar round.

9. The glide kit of claim 8, wherein the controller is further operable to determine a canard rotation angle adjustment based on the predicted position, predicted velocity, desired impact point and projected impact point of the mortar round.

10. A canard housing for a mortar ound glide kit, comprising:

a housing bottom member formed with a bottom member concave portion and first and second canard housing shrouds, wherein the first canard housing shroud is diametrically opposed from the second canard housing shroud, wherein the first canard housing shroud is formed with a first top slot, wherein the second canard housing shroud is formed with a second top slot, and wherein each of the first and second canard housing shrouds is formed with an outer slot for housing a first canard and a second canard, respectively; and a housing top member formed with a top member concave portion, a first flange at a first side edge and a second flange at a second side edge, wherein the first flange is adapted to be securely positioned within the first top slot and secured to the first canard housing shroud, and wherein the second flange is adapted to be securely positioned within the second top slot and secured to the second canard housing shroud.

11. The canard housing of claim 10, wherein the housing top member and the housing bottom member form a substantially frustoconical ring when the first top slot is secured to the first canard housing shroud and when the second top slot is secured to the second canard housing shroud.

12. The canard housing of claim 10, wherein the first canard housing shroud houses a battery, at least one sensor, a canard deployment mechanism and a canard locking mechanism.

13. The canard housing of claim 12, wherein the at least one sensor comprises a barometric pressure sensor, a shock sensor or an accelerometer.

14. The canard housing of claim 10, further comprising a first canard pivotably secured within the first canard housing shroud outer slot and a second canard pivotably secured within the second canard housing shroud outer slot.

15. The canard housing of claim 14, further comprising a controller and at least one sensor secured within the canard housing, wherein the controller is operable to receive a measurement from the at least one sensor, and based on the measurement, deploy a sweep angle adjustment to at least one of the first and second canards.

16. The canard housing of claim 10, wherein each of the first and second canard housing shrouds is formed with a leading edge, an outer side edge and a trailing edge, wherein the outer slot of the first canard housing shroud is formed in the outer side edge and the trailing edge of the first canard housing shroud and wherein the outer slot of the second canard housing shroud is formed in the outer side edge and the trailing edge of the second canard housing shroud.

17. A glide kit for a mortar round, comprising:

a wing housing securable to a tail fin assembly of a mortar round;

a canard housing securable to a front portion of the mortar round;

a plurality of canards pivotably secured to the canard housing;

a canard control subsystem operable to position each of the plurality of canards in a canard-undeployed position, a canard-expanded position and a canard-adjusted position between the canard-undeployed position and the canard-expanded position, wherein the canard control subsystem comprises a first SMA wire secured within the canard housing and around a first canard of the plurality of canards and a second SMA wire secured within the canard housing and around a second canard of the plurality of canards; and a state estimator subsystem operable to detect an adjustment-influencing condition and, based on the detected adjustment-influencing condition, instruct the canard deployment subsystem to deploy at least one of the plurality of canards into the canard-expanded position or the canard-adjusted position.

18. The glide kit of claim 17, wherein the state estimator subsystem comprises a controller and at least one sensor secured within the canard housing, and wherein the adjustment-influencing condition comprises a measurement received from the at least one sensor.

* * * * *